US006041638A

United States Patent [19]

Pinomaa et al.

[11] Patent Number: 6,041,638

[45] Date of Patent: Mar. 28, 2000

[54] METHOD FOR THE CONTINUOUS EXTRUSION OF METALS

[75] Inventors: Tuomas Mikael Pinomaa; Hannu Tapani Pajala, both of Pori, Finland; Gunnar E. Holm, Västerås, Sweden

[73] Assignee: Outokumpu Copper Oy, Finland

[21] Appl. No.: 08/819,420

[22] Filed: Mar. 17, 1997

[30] Foreign Application Priority Data

Feb. 5, 1997 [FI] Finland ..... 960965

[51] Int. Cl.[7] ..... B21C 23/00

[52] U.S. Cl. ..... 72/262

[58] Field of Search ..... 72/262, 468, 271

[56] References Cited

U.S. PATENT DOCUMENTS

| | | | |
|---|---|---|---|
| 4,044,587 | 8/1977 | Green et al. | 72/262 |
| 4,523,444 | 6/1985 | Fuchs, Jr. | 72/262 |
| 4,564,347 | 1/1986 | Vaughan | 72/262 |
| 4,650,408 | 3/1987 | Anderson et al. | 72/262 |
| 5,157,955 | 10/1992 | Hawkes et al. | 72/262 |

FOREIGN PATENT DOCUMENTS

| | | | |
|---|---|---|---|
| 58-86929 | 5/1983 | Japan | 72/262 |
| 58-90318 | 5/1983 | Japan | 72/262 |
| 58-148017 | 9/1983 | Japan | 72/262 |
| 1-104410 | 4/1989 | Japan | 72/262 |
| 4-178213 | 6/1992 | Japan | 72/262 |
| 5-329531 | 12/1993 | Japan | 72/262 |

*Primary Examiner*—Joseph J. Hail, III
*Assistant Examiner*—Ed Tolan
*Attorney, Agent, or Firm*—Morgan & Finnegan, LLP

[57] ABSTRACT

The invention relates to a method for the continuous extrusion of a metallic material, in which extrusion process the feedstock to be extruded is fed into the extrusion apparatus (4) by means of a feed member (2) advantageously provided with a groove on its outer circumference and a cooperating shoe (3) installed in said groove. According to the invention, the feed member (2) and the shoe (3) are adjusted at a desired distance from each other. In order to essentially maintain said desired distance and to eliminate the extrusion forces, the position of the shoe (3) in relation to the feed member (2) is maintained by means of an extrusion member (8) connected to the shoe (3).

6 Claims, 1 Drawing Sheet

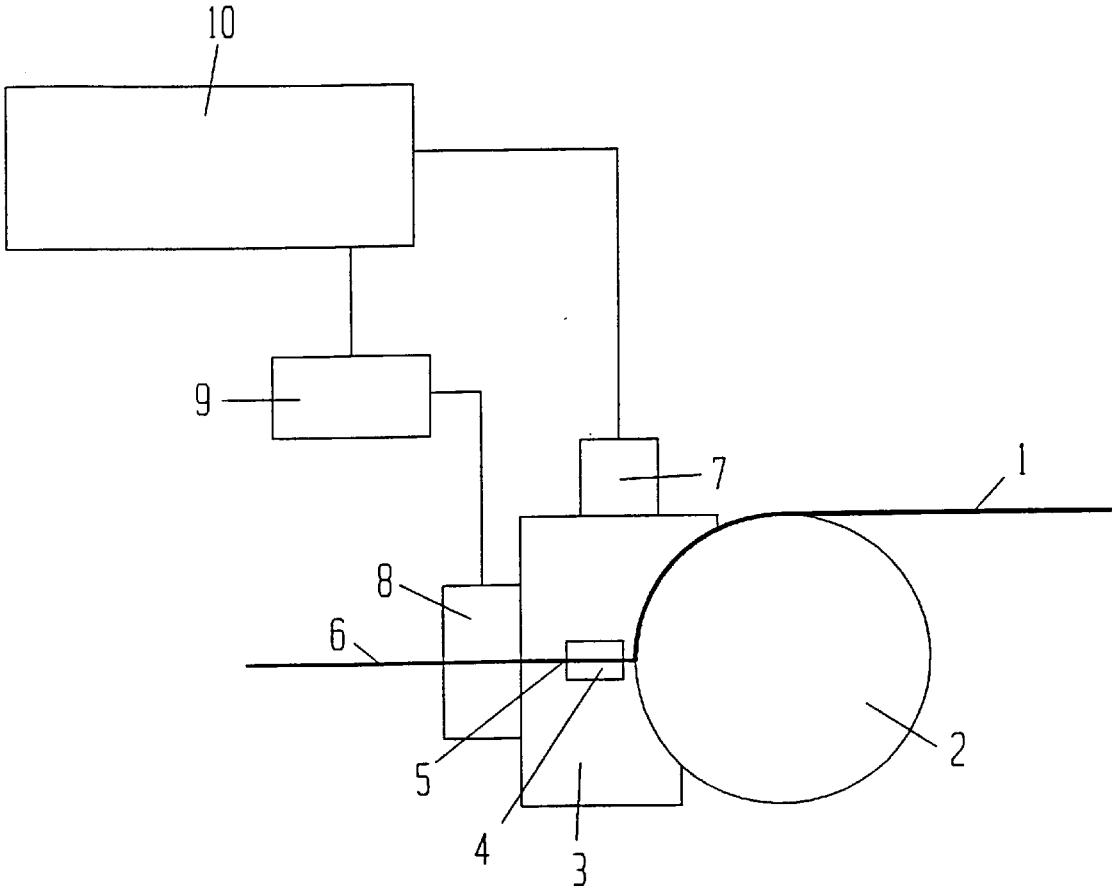
10
9
7
1
8
6
5
4
3
2

METHOD FOR THE CONTINUOUS EXTRUSION OF METALS

BACKGROUND OF THE INVENTION

The present invention relates to a method for the continuous extrusion of a metallic material, so that the amount of non-extruded material as well as drawbacks caused by thermal expansion can be reduced, and at the same time the working life of extrusion tools extended.

Continuous extrusion often applies a method described in the GB patent 1370894 and called the Conform method. In this method, the material to be extruded is conducted in a groove formed on the outer circumference of a wheel-like member. While said member rotates around its axis, the material to be extruded gets into contact with a cooperating shoe filling the groove, so that the motion of the material to be extruded with respect to the wheel-like member changes. Thus the material is fed to extrusion in the proceeding direction thereof, either prior to the cooperating shoe or through an extrusion aperture located in said member.

The metallic material to be extruded can be fed in a groove according to the Conform method in a granular, finely divided, molten or solid form. When using a granular or finely divided feedstock, the material has a large specific surface, in which case it is difficult to remove possible surface oxidation defects in the extruded product owing to the large surface area. When using solid, for instance rod-shaped feedstock, the force required for extrusion increases, but the defects caused by surface oxidation are, however, reduced. A solid, rod-like feedstock can be protected against oxidation for instance by means of a protecting hood described in the international WO patent application 95/17270.

The forces used in the extrusion of metallic material are remarkable, which leads to a rise in temperature both in the extrusion tools and the material to be extruded. This temperature rise can be prevented for example by following the method introduced in the U.S. Pat. No. 4,610,725, i.e. by conducting a cooling agent into the groove both through the feedstock feed aperture and through a specific nozzle conducting additional cooling agent directly to the groove. Moreover, according to the U.S. Pat. No. 4,610,725, the increase in temperature is prevented by feeding some cooling agent into the cooperating shoe closing the groove. This type of cooling is sufficient for instance with non-alloyed metals and extrusion products with simple transversal surfaces. When using a cooling agent, space must also be reserved for the removal thereof, which in part increases the production and maintenance costs of the apparatus.

THE INVENTION

The object of the present invention is to eliminate some of the drawbacks of the prior art and to achieve a more feasible method for the continuous extrusion of metallic materials, so that the working life and temperature of the extrusion tools can be adjusted by means of forces directed to said tools. The essential novel features of the invention are apparent from the appended patent claims.

According to the invention, the forces directed to the extrusion tools employed in the extrusion of metallic material are adjusted, so that the wheel-shaped feed member which is advantageously provided with a groove on its outer circumference, as well as the cooperating shoe installed on the outer circumference of the feed member and essentially filling said groove, are adjusted to be located at a desired distance. This distance can be advantageously adjusted by hydraulic, pneumatic or mechanical means, so that the position of the cooperating shoe in relation to the feed member is maintained by means of a compression member attached to the cooperating shoe.

According to the invention, in order to adjust the feed member and the cooperating shoe at a desired distance from each other, the position of the shoe or alternatively that of the feed member is measured by means of a shift sensor connected to the shoe or respectively to the feed member. The position of the shoe is maintained essentially constant by adjusting the pressure affecting the shoe from the exterior of the extrusion apparatus by means of the compression member connected to the shoe. In order to maintain the position of the shoe essentially at the desired distance from the feed member, the pressure created by the compression member is essentially equal to the force directed to the shoe during extrusion from inside the extrusion apparatus in the effective direction of the compression member.

When employing the method according to the invention in the extrusion of metallic objects, the control member of the compression member affecting the shoe is first set at a predetermined value which maintains the shoe at a desired distance from the feed member. When extrusion is started, the shoe is subjected to an extrusion pressure affecting from inside the extrusion apparatus, which pressure tries to shift the position of the shoe. The effect of the interior pressure for instance in the position of the shoe is measured by means of a shift sensor. The shift sensor is connected to a control unit, and the data obtained from the shift sensor is transmitted to the control unit, which creates, when necessary, a change in the pressure of the compression member directed to the shoe, in order to maintain the position of the shoe at a desired distance from the feed member. When necessary, the compression member can be used for adjusting the position of the shoe also in some other direction than in a direction essentially perpendicular to the feed member.

The distance between the feed member and the shoe can advantageously be adjusted between 0–3 mm, depending for example on the material to be extruded and on the desired shape of the extruded product. Such an adjustment in the distance is advantageously carried out prior to the extrusion of the desired material proper and the extruded product. When the distance is altered, also the control member of the compression member affecting the shoe is set at a new predetermined value. If necessary, the distance can also be altered during extrusion, in case there is a need to adjust for instance the extrusion pressure, extrusion speed or the amount of resulting flash.

When applying the method according to the invention, the amount of created flash can be essentially reduced. Moreover, because the extrusion tools can thus be maintained essentially at the desired position with respect to each other, the forces directed thereto remain essentially constant during the extrusion, which as such increases the working life of the tools. Likewise, the temperature of the tools can be maintained on an essentially constant level irrespective of the extruded material and extruded product, so that the tools stay longer in working condition.

The invention is explained in more detail below, with reference to the appended drawing which is a diagrammatic side-view illustration of a preferred embodiment of the invention.

According to the illustration, the feedstock 1 to be extruded in the continuous extrusion of a metallic material is fed in by means of a wheel-shaped feed member 2, which is rotatable around its axis and provided with a groove on its outer circumference. For extrusion, in the groove of the feed member 2 there is provided a cooperating shoe 3 in order to direct the feedstock to be extruded towards the extrusion member 4. In the extrusion member 4, there is formed an aperture 5 having the shape of the desired extruded product, in order to conduct the extruded product 6 out of the extrusion apparatus. According to the invention, a sensor 7 is connected to the shoe 3 in order to define the position of said shoe. In addition, the shoe 3 is provided with a compression member 8, the operation whereof is connected to the control member 9 of the hydraulic fluid. The sensor 7 and the control member 9 are further electrically connected to the adjusting unit 10.

When starting the extrusion, the distance between the feed member 2 and the shoe 3 is adjusted to be of the desired size, for instance 1 mm, and this value also is set in the adjusting unit 10. Now the desired position of the shoe 3 as well as the pressure of the hydraulic fluid in the control member 9 will likewise be determined. When the feedstock 1 to be extruded reaches the shoe 3, a force is directed to the shoe 3 trying to alter its position. By using the sensor 7, connected to the shoe 3, the position of the shoe 3 is defined essentially continuously. The value defined by the sensor 7 is further registered in the adjusting unit 10. When the position of the shoe 3 changes, the adjusting unit 10 sends information to that effect to the hydraulic fluid control member 9, which controls the pressure member 8 so that the pressure caused by the hydraulic fluid is essentially continuously equal to the force directed to the shoe 3 in the affective direction of the compression member 8. Thus the position of the shoe 3 can advantageously be maintained to be essentially constant throughout the extrusion. When the position of the shoe 3 remains essentially constant, also the shoe 3 and the feed member 2 remain at the desired distance from each other.

We claim:

1. A method for the continuous extrusion of metallic material, in which method the feedstock to be extruded is fed into an extrusion member by means of a feed member provided with a groove on its outer circumference and a cooperating shoe installed in said groove, characterized in that the feed member and the shoe are adjusted to be at a desired distance from each other, and that in order to maintain the feed member and the shoe essentially at the desired distance from each other and in order to eliminate extrusion forces, the position of the shoe in relation to the feed member is maintained by means of a compression member connected to the shoe.

2. A method according to claim 1, characterized in that in order to adjust the shoe at a desired distance from the feed member, the position of the shoe is measured essentially continuously.

3. A method according to claim 1, characterized in that in order to adjust the shoe at a desired distance from the feed member, the position of the feed member is measured essentially continuously.

4. A method according to claim 1, characterized in that the compression member is controlled hydraulically.

5. A method according to claim 1, characterized in that the compression member is controlled pneumatically.

6. A method according to claim 1, characterized in that the compression member is controlled mechanically.

* * * * *

UNITED STATES PATENT AND TRADEMARK OFFICE

CERTIFICATE OF CORRECTION

ATENT NO. : 6,041,638

DATED : March 28, 2000

INVENTOR(S) : TUOMAS MIKAEL PINOMAA et al.

It is certified that error appears in the above-identified patent and that said Letters Patent is hereby corrected as shown below:

Title page, under "[30] Foreign Application Priority Data", change "Feb. 5, 1997" to --Mar. 1, 1996--.

The title page, should be deleted to be replaced with the attached title page.

The drawing sheet, consisting of Fig. 1, should be deleted to be replaced with the drawing sheet, consisting of Fig. 1, as shown on the attached page.

Signed and Sealed this

Third Day of April, 2001

*Attest:*

Nicholas P. Godici

NICHOLAS P. GODICI

*Attesting Officer*

*Acting Director of the United States Patent and Trademark Office*

United States Patent [19]
Pinomaa et al.

[11] Patent Number: 6,041,638
[45] Date of Patent: Mar. 28, 2000

[54] METHOD FOR THE CONTINUOUS EXTRUSION OF METALS

[75] Inventors: Tuomas Mikael Pinomaa; Hannu Tapani Pajala, both of Pori, Finland; Gunnar E. Holm, Västerås, Sweden

[73] Assignee: Outokumpu Copper Oy, Finland

[21] Appl. No.: 08/819,420

[22] Filed: Mar. 17, 1997

[30] Foreign Application Priority Data

Feb. 5, 1997 [FI] Finland ..... 960965

[51] Int. Cl.[7] ..... B21C 23/00
[52] U.S. Cl. ..... 72/262
[58] Field of Search ..... 72/262, 468, 271

[56] References Cited

U.S. PATENT DOCUMENTS

| | | | |
|---|---|---|---|
| 4,044,587 | 8/1977 | Green et al. | 72/262 |
| 4,523,444 | 6/1985 | Fuchs, Jr. | 72/262 |
| 4,564,347 | 1/1986 | Vaughan | 72/262 |
| 4,650,408 | 3/1987 | Anderson et al. | 72/262 |
| 5,157,955 | 10/1992 | Hawkes et al. | 72/262 |

FOREIGN PATENT DOCUMENTS

| | | | |
|---|---|---|---|
| 58-86929 | 5/1983 | Japan | 72/262 |
| 58-90318 | 5/1983 | Japan | 72/262 |
| 58-148017 | 9/1983 | Japan | 72/262 |
| 1-104410 | 4/1989 | Japan | 72/262 |
| 4-178213 | 6/1992 | Japan | 72/262 |
| 5-329531 | 12/1993 | Japan | 72/262 |

*Primary Examiner*—Joseph J. Hail, III
*Assistant Examiner*—Ed Tolan
*Attorney, Agent, or Firm*—Morgan & Finnegan, LLP

[57] ABSTRACT

The invention relates to a method for the continuous extrusion of a metallic material, in which extrusion process the feedstock to be extruded is fed into the extrusion apparatus (4) by means of a feed member (2) advantageously provided with a groove on its outer circumference and a cooperating shoe (3) installed in said groove. According to the invention, the feed member (2) and the shoe (3) are adjusted at a desired distance from each other. In order to essentially maintain said desired distance and to eliminate the extrusion forces, the position of the shoe (3) in relation to the feed member (2) is maintained by means of an extrusion member (8) connected to the shoe (3).

6 Claims, 1 Drawing Sheet

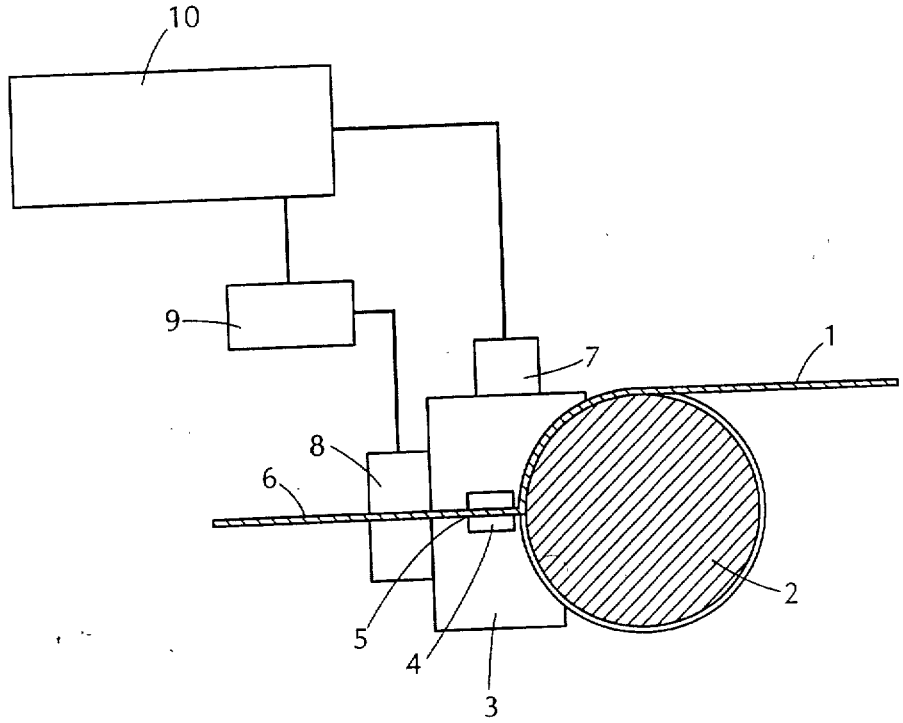

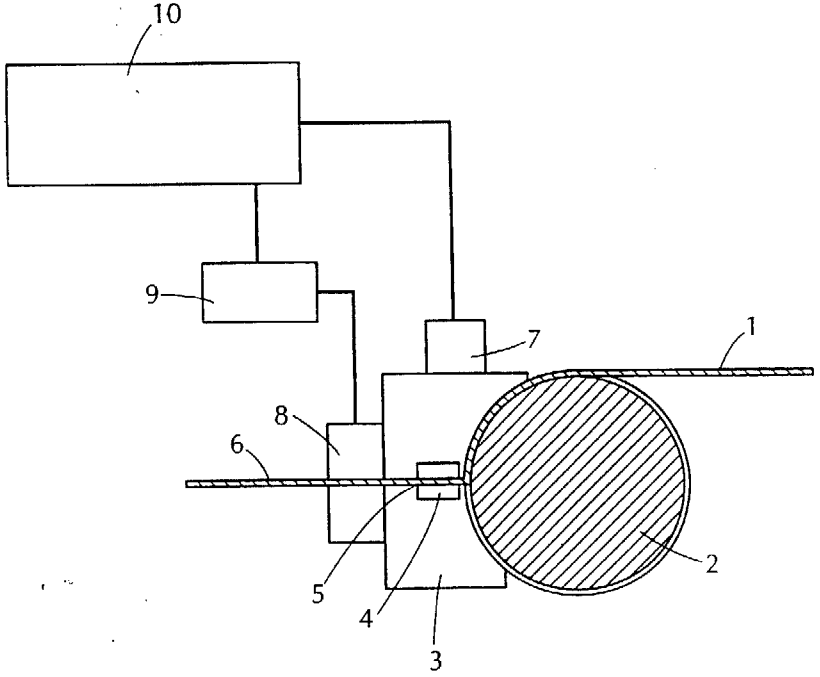
10
9
8
7
6
5
4
3
2
1